US006582283B2

(12) United States Patent
James et al.

(10) Patent No.: US 6,582,283 B2
(45) Date of Patent: Jun. 24, 2003

(54) POLISHING PADS FOR CHEMICAL MECHANICAL PLANARIZATION

(75) Inventors: David B. James, Newark, DE (US); Arun Vishwanathan, Wilmington, DE (US); Lee Melbourne Cook, Steelville, PA (US); Peter A. Burke, Avondale, PA (US); David Shidner, Newark, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 10/193,429

(22) Filed: Jul. 11, 2002

(65) Prior Publication Data

US 2003/0027500 A1 Feb. 6, 2003

Related U.S. Application Data

(63) Continuation of application No. 09/631,784, filed on Aug. 3, 2000, now Pat. No. 6,454,634.

(60) Provisional application No. 60/207,938, filed on May 27, 2000.

(51) Int. Cl.[7] ..... B24B 1/00

(52) U.S. Cl. ..... 451/41; 451/41; 451/285; 451/526; 451/533

(58) Field of Search ..... 451/36, 59, 63, 451/41, 285, 287, 289, 526, 530, 533, 536, 295

(56) References Cited

U.S. PATENT DOCUMENTS

| | | | |
|---|---|---|---|
| 3,889,430 | A | 6/1975 | Scandaletos |
| 4,927,432 | A | 5/1990 | Budinger et al. |
| 5,007,207 | A | 4/1991 | Phaal |
| 5,081,051 | A | 1/1992 | Mattingly et al. |
| 5,177,908 | A | 1/1993 | Tuttle |
| 5,247,765 | A | 9/1993 | Quintana |
| 5,394,655 | A | 3/1995 | Allen et al. |
| 5,489,233 | A | 2/1996 | Cook et al. |
| 5,569,062 | A | 10/1996 | Karlsrud |
| 5,578,362 | A | 11/1996 | Reinhardt et al. |
| 5,900,164 | A | 5/1999 | Budinger et al. |
| 6,022,268 | A | 2/2000 | Roberts et al. |
| 6,069,080 | A | 5/2000 | James et al. |
| 6,095,902 | A | 8/2000 | Reinhardt |
| 6,217,434 | B1 | 4/2001 | Roberts et al. |
| 6,287,174 | B1 | 9/2001 | Detzel et al. |
| 6,287,185 | B1 | 9/2001 | Roberts et al. |
| 6,293,852 | B1 | 9/2001 | Roberts et al. |

OTHER PUBLICATIONS

Murarka, S. P., Steigerwald, J., Gutmann, R. J., "Inlaid Copper Multilevel Interconnections Using Planarization by Chemical–Mechanical Polishing", MRS Bulletin, Jun. 1993, pp. 46–51.

*Primary Examiner*—Eileen P. Morgan
(74) *Attorney, Agent, or Firm*—Konrad Kaeding; Kenneth A. Benson

(57) ABSTRACT

An improved pad and process for polishing metal damascene structures on a semiconductor wafer. The process includes the steps of pressing the wafer against the surface of a polymer sheet in combination with an aqueous-based liquid that optionally contains sub-micron particles and providing a means for relative motion of wafer and polishing pad under pressure so that the moving pressurized contact results in planar removal of the surface of said wafer, wherein the polishing pad has a low elastic recovery when said load is removed, so that the mechanical response of the sheet is largely anelastic. The improved pad is characterized by a high energy dissipation coupled with a high pad stiffness. The pad exhibits a stable morphology that can be reproduced easily and consistently. The pad surface resists glazing, thereby requiring less frequent and less aggressive conditioning. The benefits of such a polishing pad are low dishing of metal features, low oxide erosion, reduced pad conditioning, longer pad life, high metal removal rates, good planarization, and lower defectivity (scratches and Light Point Defects).

10 Claims, No Drawings

POLISHING PADS FOR CHEMICAL MECHANICAL PLANARIZATION

This application is a continuation of U.S. application Ser. No. 09/631,784 filed Aug. 3, 2000, U.S. Pat. No. 6,454,634 which claims benefit of U.S. Provisional Application Serial No. 60/207,936 filed May 27, 2000.

FIELD OF THE INVENTION

The present invention relates generally to improved polishing pads used to polish and/or planarize substrates, particularly metal or metal-containing substrates during the manufacture of a semiconductor device. Specifically, this invention relates to pads having an optimized combination of physical properties for improved pad performance.

DISCUSSION OF THE PRIOR ART

Chemical-mechanical planarization ("CMP") is a process currently practiced in the semiconductor industry for the production of flat surfaces on integrated circuits devices. This process is discussed in "*Chemical Mechanical Planarization of Microelectronic Materials*", J. M. Steigerwald, S. P. Murarka, R. J. Gutman, Wiley, 1997, which is hereby incorporated by reference in its entirety for all useful purposes. Broadly speaking, CMP involves flowing or otherwise placing a polishing slurry or fluid between an integrated circuit device precursor and a polishing pad, and moving the pad and device relative to one another while biasing the device and pad together. Such polishing is often used to planarize: i. insulating layers, such as silicon oxide; and/or ii. metal layers, such as tungsten, aluminum, or copper.

As semiconductor devices become increasingly complex (requiring finer feature geometries and greater numbers of metallization layers), CMP must generally meet more demanding performance standards. A relatively recent CMP process has been the fabrication of metal interconnects by the metal damascene process (see for example, S. P. Murarka, J. Steigerwald, and R. J. Gutmann, "*Inlaid Copper Multilevel Interconnections Using Planarization by Chemical Mechanical Polishing*", MRS Bulletin, pp. 46–51, June 1993, which is hereby incorporated by reference in its entirety for all useful purposes).

With damascene-type polishing, the polished substrate is generally a composite rather than a homogenous layer and generally comprises the following basic steps: i. a series of metal conductor areas (plugs and lines) are photolithographically defined on an insulator surface; ii. the exposed insulator surface is then etched away to a desired depth; iii. after removal of the photoresist, adhesion layers and diffusion barrier layers are applied; iv. thereafter, a thick layer of conductive metal is deposited, extending above the surface of the insulator material of the plugs and lines; and v. the metal surface is then polished down to the underlying insulator surface to thereby produce discrete conductive plugs and lines separated by insulator material.

In the ideal case after polishing, the conductive plugs and lines are perfectly planar and are of equal cross-sectional thickness in all cases. In practice, significant differences in thickness across the width of the metal structure can occur, with the center of the feature often having less thickness than the edges. This effect, commonly referred to as "dishing", is generally undesirable as the variation in cross-sectional area of the conductive structures can lead to variations in electrical resistance. Dishing arises because the harder insulating layer (surrounding the softer metal conductor features) polishes at a slower rate than the metal features. Therefore, as the insulating region is polished flat, the polishing pad tends to erode away conductor material, predominantly from the center of the metal feature, which in turn can harm the performance of the final semiconductor device.

SUMMARY OF THE INVENTION

The present invention is directed to polishing pads for CMP having low elastic recovery during polishing, while also exhibiting significant anelastic properties relative to many known polishing pads. In some embodiments, the pads of the present invention further define: i. a surface roughness of about 1 to about 9 microns Ra; ii. a hardness of about 40 to about 70 Shore D; and iii. a tensile Modulus up to about 2000 MPa at 40° C. In one embodiment, the polishing pads of the present invention define a ratio of E' at 30° and 90° C. being less than about 5, preferably less than about 4.6 and more preferably less than about 3.5. In other embodiments of the present invention, the polishing pad defines a ratio of E' at 30° C. and 90° C. from about 1.0 to about 5.0 and a KEL from about 100 to about 1000 (1/Pa) (40° C.). In other embodiments, the polishing pad has a surface roughness of about 2 to about 7 micron Ra, a hardness of about 45 to about 65 Shore D, a Modulus E' of about 150 to about 1500 MPa at 40° C., a KEL of about 125 to about 850 (1/Pa at 40° C.) and a ratio of E' at 30° C. and 90° C. of about 1.0 to about 4.0. In yet other embodiments, the polishing pads of the present invention have a surface roughness of about 3 to about 5 micron Ra, a hardness of about 55 to about 63 Shore D, a Modulus E' of 200 to 800 MPa at 40° C., KEL of 150 to 400 (1/Pa at 40° C.) and a ratio of E' at 30° C. and 90° C. of 1.0 to 3.5.

In one embodiment, the modulus value can be as low as about 100 MPa, provided the pad is (sufficiently) hydrolytically stable. Such stability is characterized by substantially stable pad performance as the pad is increasingly subjected to water based fluids.

In other embodiments, the present invention is directed to a process for polishing metal damascene structures on a semiconductor wafer by: i. pressing the wafer against the surface of a pad in combination with an aqueous-based liquid that optionally contains sub-micron particles; and ii. providing mechanical or similar-type movement for relative motion of wafer and polishing pad under pressure so that the moving pressurized contact results in planar removal of the surface of said wafer.

DESCRIPTION OF THE INVENTION

The preferred pads of the present invention are characterized by high-energy dissipation, particularly during compression, coupled with high pad stiffness. Preferably, the pad exhibits a stable morphology that can be reproduced easily and consistently. Furthermore, the pad surface preferably resists glazing, thereby requiring less frequent and less aggressive conditioning and resulting in low pad wear and longer pad life. In one embodiment, the polishing pads of the present invention exhibit low dishing of metal features, low oxide erosion, reduced pad conditioning, high metal removal rates, good planarization, and/or lower defectivity (scratches and light point defects), relative to known polishing pads.

The pads of the present invention can be made in any one of a number of different ways. Indeed, the exact composition generally is not important so long as the pads exhibit low elastic recovery during polishing. Although urethanes are a preferred pad material, the present invention is not limited to polyurethanes and can comprise virtually any chemistry capable of providing the low elastic recovery described herein. The pads can be, but are not limited to, thermoplastics or thermosets and can be filled or unfilled. The pads of the present invention can be made by any one of a number of polymer processing methods, such as but not limited to, casting, molding, coating, extruding, photoimaging, printing, sintering, and the like.

In a preferred embodiment, the pads of the present invention have one or more of the following attributes:

1. Dishing of conductive features such as conductors and plugs is minimal,
2. Die-level planarity is achieved across the wafer surface, and/or
3. Defects such as scratches and light-point-defects are minimal and do not adversely effect electrical performance of the semiconductor device.

The above attributes can be influenced and sometimes controlled through the physical properties of the polishing pad, although pad performance is also dependent on all aspects of the polishing process and the interactions between pad, slurry, polishing tool, and polishing conditions, etc.

In one embodiment, the pads of the present invention define a polishing surface which is smooth, while still maintaining micro-channels for slurry flow and nano-asperities to promote polishing. One way to minimize pad roughness is to construct an unfilled pad, since filler particles tend to increase pad roughness.

Pad conditioning can also be important. Sufficient conditioning is generally required to create micro-channels in the pad surface and to increase the hydrophilicity of the pad surface, but over-conditioning can roughen the surface excessively, which in turn can lead to an increase in unwanted dishing.

The pads of the present invention preferably have low elastic rebound. Such rebound can often be quantified by any one of several metrics. Perhaps the simplest such metric involves the application of a static compressive load and the measurement of the percent compressibility and the percent elastic recovery. Percent compressibility is defined as the compressive deformation of the material under a given load, expressed as a percentage of the pad's original thickness. Percent elastic recovery is defined as the fraction of the compressive deformation that recovers when the load is removed from the pad surface.

However, the above test for elastic rebound may be flawed, since polishing is a dynamic process and may not be adequately defined using static parameters. Also, polishing pads tend to be polymeric exhibiting viscoelastic behavior; therefore, perhaps a better method of characterization is to use the techniques of dynamic mechanical analysis (see J. D. Ferry, "*Viscoelastic Properties of Polymers*", New York, Wiley, 1961 which is hereby incorporated by reference in its entirety for all useful purposes).

Viscoelastic materials exhibit both viscous and elastic behavior in response to an applied deformation. The resulting stress signal can be separated into two components: an elastic stress which is in phase with the strain, and a viscous stress which is in phase with the strain rate but 90 degrees out of phase with the strain. The elastic stress is a measure of the degree to which a material behaves as an elastic solid; the viscous stress measures the degree to which the material behaves as an ideal fluid. The elastic and viscous stresses are related to material properties through the ratio of stress to strain (this ratio can be defined as the modulus). Thus, the ratio of elastic stress to strain is the storage (or elastic) modulus and the ratio of the viscous stress to strain is the loss (or viscous) modulus. When testing is done in tension or compression, E' and E" designate the storage and loss modulus, respectively.

The ratio of the loss modulus to the storage modulus is the tangent of the phase angle shift (δ) between the stress and the strain. Thus, $$E''/E' = \tan\delta$$

and is a measure of the damping ability of the material.

Polishing is a dynamic process involving cyclic motion of both the polishing pad and the wafer. Energy is generally transmitted to the pad during the polishing cycle. A portion of this energy is dissipated inside the pad as heat, and the remaining portion of this energy is stored in the pad and subsequently released as elastic energy during the polishing cycle. The latter is believed to contribute to the phenomenon of dishing.

It has been discovered that pads which have relatively low rebound and which absorb the relatively high amounts of energy during cyclic deformation tend to cause relatively low amounts of dishing during polishing. There are several parameters which may be used to describe this effect quantitatively. The simplest is Tan δ, defined above. However, perhaps a better parameter for predicting polishing performance is known as the "Energy Loss Factor". ASTM D4092-90 ("Standard Terminology Relating to Dynamic Mechanical Measurements of Plastics" which is incorporated by reference in its entirety for all useful purposes) defines this parameter as the energy per unit volume lost in each deformation cycle. In other words, it is a measure of the area within the stress-strain hysteresis loop.

The Energy Loss Factor (KEL) is a function of both tan δ and the elastic storage modulus (E') and may be defined by the following equation:

$$KEL = \tan\delta * 10^{12}/[E'*(1+\tan\delta^2)]$$

where E' is in Pascals.

The higher the value of KEL for a pad, generally the lower the elastic rebound and the lower the observed dishing.

One method to increase the KEL value for a pad is to make it softer. However, along with increasing the KEL of the pad, this method tends to also reduce the stiffness of the pad. This can reduce the pad's planarization efficiency which is generally undesirable.

A preferred approach to increase a pad's KEL value is to alter its physical composition in such a way that KEL is increased without reducing stiffness. This can be achieved by altering the composition of the hard segments (or phases) and the soft segments (or phases) in the pad and/or the ratio of the hard to soft segments (or phases) in the pad. This results in a preferred pad that has a suitably high hardness with an acceptably high stiffness to thereby deliver excellent planarization efficiency.

The morphology of a polymer blend can dictate its final properties and thus can affect the end-use performance of the polymer in different applications. The polymer morphology can be affected by the manufacturing process and the properties of the ingredients used to prepare the polymer. The components of the polymer used to make the polishing pad should preferably be chosen so that the resulting pad morphology is stable and easily reproducible.

In another embodiment of this invention, the glass transition temperature of the polymer used to make the polishing pad is shifted to sub-ambient temperatures without impacting the stiffness of the pad appreciably. Lowering the glass transition temperature (Tg) of the pad increases the KEL of the pad and also creates a pad whose stiffness changes very little between the normal polishing temperature range of 20° C. and 100° C. Thus changes in polishing temperature have minimal effect on pad physical properties, especially stiffness. This can result in more predictable and consistent performance.

A feature of one embodiment of this invention is the ability to shift the glass transition temperature to below room temperature and to design a formulation which results in the modulus above Tg being constant with increasing temperature and of sufficiently high value to achieve polishing planarity. Modulus consistency can often be improved through either crosslinking, phase separation of a "hard", higher softening temperature phase, or by the addition of inorganic fillers (alumina, silica, Ca $CO_3$, etc.).

Another advantage of shifting the Tg (glass transition temperature) of the polymer to sub-ambient temperatures is that in some embodiments of the invention, the resulting pad surface can be more resistant to glazing.

Potential attributes of the pad of the present invention include:

1. High pad stiffness and pad surface hardness;
2. High energy dissipation (high KEL);
3. Stable morphology that can be reproduced easily and consistently, and which does not change significantly or adversely during polishing;
4. Pad surface that reduces glazing, thereby requiring less frequent and less aggressive conditioning, resulting in low pad wear during polishing and long pad life;
5. No porosity and surface voids thereby reducing pockets that trap used slurry and increase pad roughness. This reduces and almost eliminates a major source of defects in wafers; and/or
6. Pad chemistry can be easily altered to make it suitable for polishing a wide variety of wafers.

One or more of the above features can often translate into the following polishing benefits:

1. The high pad stiffness yields wafers that have good planarity;
2. The pad's top layer conditions more easily and uniformly with low glazing, and this reduces scratches and LPD defects on polished IC wafers when compared to other pads, such as IC1010;
3. Lower final dishing is seen on pattern wafers even at extended overpolish times. This is attributable to the favorable combination of high KEL and high modulus;
4. Larger polish window on pattern wafers when compared to standard pads;
5. No feature specific dishing observed on pattern wafers; and/or
6. Pad stiffness changes very little between the normal polishing temperature range of 20° C. and 100° C. leading to a very stable and uniform polishing.

In summary:

1. Preferred pads for metal CMP generally have an optimized combination of one or more of the following: stiffness (modulus and thickness), Energy Loss Factor (KEL), modulus-temperature ratio, hardness, and surface roughness: by varying the pad composition, these can be somewhat independently controlled;
2. Pads with low elastic recovery generally produce low dishing of features during metal CMP polishing;
3. Low elastic recovery can be defined in terms of the "Energy Loss Factor" (KEL);
4. Preferred ranges for these parameters are shown below:

| Parameter | Range | Preferred Range | Most Preferred |
|---|---|---|---|
| Thickness (mil) | 20–100 | 30–90 | 40–80 |
| Surface Roughness, Ra ($\mu$) | 1–9 | 2–7 | 3–5 |
| Hardness (Shore D) | 40–70 | 45–65 | 55–63 |
| Modulus, E' (MPa) (40° C.) | 100–2000 | 150–1500 | 200–800 |
| KEL (1/Pa) (40° C.) | 100–1000 | 125–850 | 150–400 |
| Ratio of E' at 30° C. & 90° C. | 1.0–4.6 | 1.0–4.0 | 1.0–3.5 |

Modulus, (E') and Energy Loss Factor (KEL) are measured using the method of Dynamic Mechanical Analysis at a temperature of 40° C. and frequency of 10 radians/sec. KEL is calculated using the equation defined earlier.

The last row defines the ratio of the modulus measured at 30° C. and 90° C. This represents the useful temperature range for polishing. Ideally, modulus will change as little as possible and in a linear trend with increasing temperature (i.e. ratio approaches unity). Surface roughness values are after conditioning.

From the above table, it is apparent that preferred pads of this invention will generally have a flat modulus-temperature response, a high KEL value in combination with a high modulus value, and low surface roughness after conditioning.

EXAMPLES

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

Pads of the present invention may be produced by typical pad manufacturing techniques such as casting, molding, extrusion, photoimaging, printing, sintering, coating, etc. Pads may be unfilled or optionally filled with materials such as polymeric microballoons or inorganic fillers such as silica, alumina and calcium carbonate.

Pads of the present invention can be designed to be useful for both conventional rotary and for next generation linear polishers (roll or belt pads).

Additionally, pads of the present invention can be designed to be used for polishing with conventional abrasive containing slurries, or alternatively, the abrasive may be incorporated into the pad and the pad used with a particle free reactive liquid, or in yet another embodiment, a pad of the present invention without any added abrasives may be used with a particle free reactive liquid (this combination is particularly useful for polishing materials such as copper).

The following, non-limiting examples illustrate the benefits of the present invention. Examples 1 and 2 represent comparative prior art pads.

Comparative Example 1

(Prior Art)

This example refers to prior art pads disclosed in U.S. Pat. Nos. 5,578,362 and 5,900,164.

A polymeric matrix was prepared by mixing 2997 grams of polyether-based liquid urethane (Uniroyal ADIPRENE® L325) with 768 grams of 4,4-methylene-bis-chloroaniline (MBCA) at about 65° C. At this temperature, the urethane/polyfunctional amine mixture has a pot life of about 2.5 minutes; during this time, about 69 grams of hollow elastic polymeric microspheres (EXPANCEL® 551DE) were blended at 3450 rpm using a high shear mixer to evenly distribute the microspheres in the mixture. The final mixture was transferred to a mold and permitted to gel for about 15 minutes.

The mold was then placed in a curing oven and cured for about 5 hours at about 93° C. The mixture was then cooled for about 4–6 hours, until the mold temperature was about 21° C. The molded article was then "skived" into thin sheets and macro-channels mechanically machined into the surface ("Pad A").

Similarly, another filled pad (("Pad B"), was made in an analogous manner with the exception that ADIPRENE® L325 was replaced with a stoichiometrically equivalent amount of ADIPRENE® L100.

A third pad ("Pad C") was made by the same manufacturing process as described above but the polyurethane was unfilled.

Comparative Example 2

(Prior Art)

This example refers to a pad ("Pad 2A") made by a molding process disclosed in U.S. Pat. No. 6,022,268.

In order to form the polishing pad, two liquid streams were mixed together and injected into a closed mold, having the shape of the required pad. The surface of the mold is typically grooved so that the resulting molded pad also has a grooved macrotexture to facilitate slurry transport. The first stream comprised a mixture of a polymeric diol and a polymeric diamine, together with an amine catalyst. The second stream comprised diphenylmethanediisocyanate (MDI). The amount of diisocyanate used was such as to give a slight excess after complete reaction with diol and diamine groups.

The mixed streams were injected into a heated mold at about 70° C. to form a phase separated polyurethane-urea polymeric material. After the required polymerization time had elapsed, the now solid part, in the form of a net-shape pad, was subsequently demolded.

Table 1 shows key physical properties for the pads described in Examples 1 and 2:

TABLE 1

Physical Properties of Pad 1A, Pad 1B, Pad 1C, Pad 2A

| | Parameter | | | |
|---|---|---|---|---|
| Example # | Pad 1A 1A | Pad 1B 1B | Pad 1C 1C | Pad 2A 2 |
| Surface Roughness, Ra ($\mu$) | 10–14 | 2–5 | Similar IC1000 | 1–4 |
| Hardness (Shore D) | 50–55 | 73 | 29 | 60–65 |
| Modulus (MPa) (40° C.) | 370 | 926 | 26 | 1580 |
| KEL (1/Pa) (40° C.) | 243 | 108 | 766 | 33 |
| Ratio of E' at 30° C. & 90° C. | 5.2 | 6.4 | 7.5 | 11.8 |

Example 3

Example 3 illustrates the making of filled and unfilled pads, in accordance with the present invention, using a casting process analogous to that described in Example 1.

Unfilled castings (Examples 3A, B and C) were prepared using the isocyanate ADIPRENES shown in Table 2 cured with 95% of the theoretical amount of MBCA curing agent. Preparation consisted of thoroughly mixing together ADIPRENE and MBCA ingredients and pouring the intimate mixture into a circular mold to form a casting. Mold temperature was 100° C. and the castings were subsequently post-cured for 16 hours at 100° C. After post-curing, the circular castings were "skived" into thin 50 mil thick sheets and macro-channels were mechanically machined into the surface. Channels were typically 15 mil deep, 10 mil wide, with a pitch of 30 mil. Properties of the castings are shown in Table 2 and illustrate the favorable combination of key physical properties required for improved polishing of metal layers in a CMP process:

Example 3D contains 2 wt % EXPANCEL® 551DE and is made as described in Example 1.

TABLE 2

Properties of Cast Pads

| Example # | 3A | 3B | 3C | 3D |
|---|---|---|---|---|
| Type | Unfilled | Unfilled | Unfilled | Fitted |
| ADIPRENE ® (1) | LF1950A | LF950A | LF700D | LF751D |
| EXPANCEL ® 551DE | 0 | 0 | 0 | 2 wt% |
| Hardness (Shore D) | 40 | 50 | 70 | 59 |
| Modulus (MPa) (40° C.) | 120 | 122 | 533 | 452 |
| KEL (1/Pa) (40° C.) | 714 | 666 | 285 | 121 |
| Ratio of E' at 30° C. & 90° C. | 1.3 | 1.1 | 2.5 | 2.7 |

(Note 1: ADIPRENE ® LF products are Toluene Diisocyanate based prepolymers manufactured by Uniroyal Chemical Company Inc.)

Example 4

Example 4 illustrates making pads of the present invention using a molding process analogous to that described in Example 2. Table 3 shows the composition and key physical properties of typical pads made by a molding process. Molding conditions are as described in Example 2.

TABLE 3

Composition and Properties of Molded Pads

| | Examples | | | |
|---|---|---|---|---|
| Composition | 4A | 4B | 4C | 4D |
| Polyamine (Eq. Wt. 425) | 24.71 | 18.42 | 18.43 | 34.84 |
| Polyamine (Eq. Wt. 220) | 24.71 | 30.05 | 30.56 | 24.39 |
| Polypropylene Glycol (Eq. Wt. 1000) | 21.18 | 20.77 | | |
| Polypropylene Glycol (Eq. Wt. 2100) | | | 21.12 | 10.45 |
| MDI (Eq. Wt. 144.5) | 29.39 | 30.77 | 29.59 | 30.33 |
| Hardness (Shore D) | 52 | 51 | 57 | 60 |
| Modulus (MPa) (40° C.) | 196 | 214 | 657 | 690 |
| KEL (1/Pa) (40° C.) | 517 | 418 | 208 | 199 |
| Ratio of E' at 30° C. and 90° C. | 4.6 | 4.1 | 4.2 | 3.4 |
| Normalized Copper Removal Rate | 0.713 | 0.648 | 0.616 | 0.919 |

(Numbers refer to weight percent of each component)

A typical pad formulation from Table 3 was used to polish copper patterned wafers in order to measure dishing of fine copper features. Polishing performance was compared to that of a pad as prepared in Example 1.

Both pads were polished using an Applied Materials' MIRRA polisher using a platen speed of 141 rpm, a carrier speed of 139 rpm, and a down-force of 4 psi. The pads were both preconditioned before use using an ABT conditioner. Post conditioning was used between wafers. Sematech pattern wafer 931 test masks containing copper features of different dimensions were polished using the pads in conjunction with an experimental copper slurry (CUS3116) from Rodel.

After polishing, the copper features were measured for dishing using atomic force microscopy. Defects were measured using an Orbot Instruments Ltd. wafer inspection system. Table 4 summarizes dishing and defect data for the pads polished.

TABLE 4

Patterned Wafer Polishing Data for Molded Pad

| | Dishing (A) versus Feature Size and Type | | | | |
|---|---|---|---|---|---|
| Pad Type | 10 μ Line | 25 μLine | 100 μ Line | Bond Pad | Defects (#) |
| IC1010 Control | 1037 | 1589 | 2197 | 2009 | 14760 |
| Molded Pad | 455 | 589 | 775 | 392 | 265 |

It is clearly apparent from the data that the molded pad significantly reduces dishing and defectivity.

Example 5

Example 5 illustrates making pads of the present invention from thermoplastic polymers using an extrusion process. A polyether type thermoplastic polyurethane was blended with 20 wt % of either 4 micron or 10 micron calcium carbonate filler using a Haake mixer. The resulting blend, together with the unfilled polymer, was extruded into a 50 mil sheet using a twin-screw extruder manufactured by American Leistritz. Additional formulations were prepared by blending together the above polyether based TPU with a softer polyester based TPU. These were again filled with calcium carbonate. The key physical properties of the sheets were measured and are shown in Table 5:

TABLE 5

Composition and Properties of Extruded Pads

| | Examples | | | | | |
|---|---|---|---|---|---|---|
| Composition | 5A | 5B | 5C | 5D | 5E | 5F |
| Polyether based TPU (nominal hardness 65D) (wt %) | 100 | 80 | 80 | 75 | 60 | 60 |
| Polyester based TPU (nominal hardness 45D) (wt %) | — | | | 25 | 20 | 20 |
| 4 micron Calcium Carbonate (wt %) | — | 20 | | | 20 | |
| 10 micron Calcium Carbonate (wt %) | — | | 20 | | | 20 |
| Modulus (MPa) (40° C.) | 204 | 567 | 299 | 416 | 309 | 452 |
| KEL (1/Pa) (40° C.) | 547 | 167 | 394 | 168 | 269 | 170 |
| Ratio of E' at 30° C. and 90° C. | 2.4 | 1.7 | 2.2 | 1.6 | 1.8 | 1.6 |

Although thermoplastic polyurethane (TPU's) examples are used to illustrate the invention, the invention is not limited to TPU's. Other thermoplastic or thermoset polymers such as nylons, polyesters, polycarbonates, polymethacrylates, etc. are also applicable, so long as the key property criteria are achieved. Even if not achievable by an unfilled thermoplastic polymer, the properties may be realized by modifying the base polymer properties by filling with organic or inorganic fillers or reinforcements, blending with other polymers, copolymerization, plasticization, or by other formulation techniques known to those skilled in the art of polymer formulation.

A typical pad formulation from Table 5 was used to polish copper patterned wafers in order to measure dishing of fine copper features. Polishing performance was compared to that of a pad as prepared in Example 1.

Both pads were polished using an Applied Materials' MIRRA polisher using a platen speed of 141 rpm, a carrier speed of 139 rpm, and a down-force of 4 psi. The pads were both preconditioned before use using an ABT conditioner. Post conditioning was used between wafers. Sematech pattern wafer 931 test masks containing copper features of different dimensions were polished using the pads in conjunction with slurry.

After polishing, the copper features were measured for dishing using atomic force microscopy. Defects were measured using an Orbot Instruments Ltd. wafer inspection system. Table 6 summarizes dishing and defect data for the pads polished.

TABLE 6

Patterned Wafer Polishing Data for Extruded Pad

| | Dishing (A) versus Feature Size and Type | | | |
|---|---|---|---|---|
| Pad Type | 10 μ Line | 25 μ Line | 100 μ Line | Bond Pad |
| Control | 1037 | 1589 | 2197 | 2009 |
| Extruded Pad | 750 | 923 | 1338 | 641 |

It is clearly apparent from the data that the extruded pad significantly reduces dishing.

Regarding hydrolytic stability, the attached Table shows changes in pad properties after immersion in deionized water at room temperature (25° C.) for 24 hours. Chance in Pad Properties after Immersion in Water

| | Example 4D | | | Example 5A | | | Example 3C | | |
|---|---|---|---|---|---|---|---|---|---|
| Parameter | Dry | Wet | % Change | Dry | Wet | % Change | Dry | Wet | % Change |
| Swelling (in)[a] | 0.890 | 0.892 | 0.2 | 0.890 | 0.892 | 0.2 | 0.890 | 0.894 | 0.4 |
| Hardness (Shore D) | 58.5 | 44.7 | −23.6 | 48.2 | 42.7 | −11.4 | 65.6 | 60.0 | −8.5 |
| Modulus, E' (MPa) (40° C.) | 690 | 568 | −17.7 | 232 | 164 | −29.3 | 510 | 344 | −32.5 |

-continued

| Parameter | Example 4D | | | Example 5A | | | Example 3C | | |
|---|---|---|---|---|---|---|---|---|---|
| | Dry | Wet | % Change | Dry | Wet | % Change | Dry | Wet | % Change |
| KEL (1/Pa) (40° C.) | 181 | 240 | 32.7 | 620 | 622 | 0.4 | 261 | 360 | 37.8 |
| Ratio of E' at 30° C. & 90° C. | 2.35 | 2.16 | −7.9 | 2.52 | 2.14 | −14.8 | 2.19 | 1.41 | −35.6 |

[a]Change in linear dimension after immersion in deionized water for 24 hours at room temperature (25° C).

The above pads are hydrolytically stable, because the linear dimension of the pad changes by less than about 1%, after immersion in deionized water for 24 hours at room temperature (25° C.). In alternative embodiments, hydrolytic stability is defined as "the hardness of the pads will decrease by less than 30%, after immersion in deionized water for 24 hours at room temperature (25° C.).

For hydrolytically stable pads in accordance with the present invention, the pad properties have the following ranges:

| Parameter | Range | Preferred Range | Most Preferred |
|---|---|---|---|
| Thickness (mil) | 20–100 | 30–90 | 40–80 |
| Surface Roughness, Ra ($\mu$) | 1–9 | 2–7 | 3–5 |
| Hardness (Shore D) | 40–70 | 45–65 | 55–63 |
| Modulus, E' (MPa) (40° C.) | 100–2000 | 150–1500 | 200–800 |
| KEL (1/Pa) (40° C.) | 100–1000 | 125–850 | 150–400 |
| Ratio of E' at 30° C. & 90° C. | 1.0–4.6 | 1.0–4.0 | 1.0–3.5 |

For hydrolytically stable pads, after immersion in deionized water for 24 hours at room temperature (25° C.), properties still fall within above ranges.

The above discussion is not meant to be limiting in any way, and the scope of the present invention is intended to be defined solely in accordance with the following claims.

What is claimed is:

1. A polishing pad for planarizing a surface of a semiconductor device or a precursor thereto, said pad being characterized by; a polishing layer for planarizing said surface, said layer having a KEL of about 100–1,000 (1/Pa at 40° C.).

2. A polishing pad according to claim 1, wherein the polishing layer further has an E' ratio at 30° C.–90° C. of about 1–4.6.

3. A polishing pad according to claim 1, wherein the polishing layer further has a hardness of about 40–70 Shore D.

4. A polishing pad according to claim 1, wherein the polishing layer further has a tensile Modulus of about 100–2,000 MPa at 40° C.

5. A polishing pad according to claim 1, wherein each linear dimension of said pad changes by less than about 1% when said pad is immersed in deionized water for 24 hours at an ambient temperature of about 25° C.

6. A polishing pad according to claim 1, wherein the hardness of said pad decreases by less than about 30% when said pad is immersed in deionized water for 24 hours at an ambient temperature of about 25° C.

7. A polishing pad according to claim 1, wherein the polishing layer has a surface roughness of from about one to about nine micron Ra.

8. A process for polishing a metal damascene structure of a semiconductor wafer comprising:

biasing the wafer toward an interface between the wafer and a polishing layer of a polishing pad; flowing a polishing fluid into the interface; and providing relative motion of the wafer and the polishing pad under pressure so that the moving pressurized contact of the polishing fluid against the wafer results in planar removal along a surface of said wafer;

said polishing layer having a KEL of about 100–1,000 (1/Pa at 40° C.).

9. A process according to claim 8, further comprising, attracting a complexing agent of the polishing fluid to the metal, and protecting a surface of the metal until disrupted by the polishing pad, said movement occurring at a distance between the polishing pad and the metal being less than the average dimension of nano-asperities of less than, 500 Angstroms along a polishing surface of the polishing layer.

10. A process according to claim 8, further comprising: changing each linear dimension of said pad by less than about 1%, and decreasing the hardness of said pad by less than about 30%, by said pad being in deionized water for 24 hours at an ambient temperature of about 25° C.

* * * * *